US005900082A

United States Patent [19]

Hewitt

[11] Patent Number: 5,900,082

[45] Date of Patent: May 4, 1999

[54] METHOD OF MAKING A HEAT TREATED STEEL CASTING AND A HEAT TREATED STEEL CASTING

[75] Inventor: Paul Herbert Hewitt, Angus, United Kingdom

[73] Assignee: NACO, Inc., Downers Grove, Ill.

[21] Appl. No.: 08/973,740

[22] PCT Filed: Apr. 15, 1997

[86] PCT No.: PCT/GB97/01024

§ 371 Date: Dec. 11, 1997

§ 102(e) Date: Dec. 11, 1997

[87] PCT Pub. No.: WO97/40196

PCT Pub. Date: Oct. 30, 1997

[30] Foreign Application Priority Data

Apr. 19, 1996 [GB] United Kingdom ..... 9608108

[51] Int. Cl.[6] ..... C21D 6/00; C22C 38/42; C22C 38/44

[52] U.S. Cl. ..... 148/664; 148/662; 148/332; 148/320

[58] Field of Search ..... 148/662, 660, 148/664, 332, 333, 320; 420/91

[56] References Cited

U.S. PATENT DOCUMENTS 4,398,970 8/1983 Marder et al. .

FOREIGN PATENT DOCUMENTS 2 078 143 11/1971 France .

OTHER PUBLICATIONS

Analysis of Intercritical Heat Treatment of Cast Steels, Journal of Heat Treating, vol. 1, No. 2, 1989, Robert C. Voight.

Mechanical Properties of Ferritic—Martensitic Structures of a 0.2% C Steel with Different Distribution of the Phases, Zeitschrift Fur Metallkunde, Jun. 1988, Karl Heinz Zum Gahr and Michael Rosenheinrich.

Patent Abstracts of Japan No. 04160111, Jun. 3, 1992, Heat Treatment for Cast Steel Product, Kubota Corp.

Patent Abstracts of Japan No. 07102316, Apr. 18, 1995, Heat Treatment for Steel Casting, Kubuto Corp.

*Primary Examiner*—Deborah Yee

*Attorney, Agent, or Firm*—Lee, Mann, Smith, McWilliams, Sweeney & Ohlson

[57] ABSTRACT

A method of making a heat treated steel casting comprising the steps of taking an "as-cast" steel casting comprising not more than 0.2% carbon, a total alloy content of less than about 4%, a carbon equivalent, as herein defined, lying in the range 0.45–0.7 and cooling the casting after performing the casting operation and then performing a heat treatment operation by re-heating the casting to a temperature above the $AC_3$ temperature to homogenize the casting, then cooling the casting to an inter-critical temperature lying between the $AC_3$ and $AC_1$ temperature and then quenching to room temperature.

27 Claims, 6 Drawing Sheets

METHOD OF MAKING A HEAT TREATED STEEL CASTING AND A HEAT TREATED STEEL CASTING

DESCRIPTION OF INVENTION

This invention relates to a method of making a heat treated steel casting and to a heat treated steel casting.

It is known to make steel castings of a low alloy steel by casting in air followed by a solution heat treatment, then quenching and finally tempering the casting. Whilst such castings may have relatively good toughness, as obtained by Charpy impact test, a relatively high hardness is not achieved. For example, whilst toughness may lie in the range 10–40 (V-notch Charpy), a hardness of only about 300–350 Brinell may be obtained.

The above mentioned properties may be improved to a limited extent by utilising techniques such as vacuum induction melting but high hardness with high toughness is not achieved. However, this form of bulk casting production is not practical.

Objects of the invention are to provide a method of making a heat treated steel casting and a heat treated steel casting which overcomes or reduces the above mentioned disadvantages.

According to one aspect of the invention we provide a method of making a heat treated steel casting comprising the steps of taking an "as-cast" steel casting comprising not more than 0.2% carbon, a total alloy content of less than about 4%, a carbon equivalent, as herein defined, lying in the range 0.45–0.7 after cooling subsequent to and performing a heat treatment operation by re-heating the casting to a temperature above the $AC_3$ temperature to homogenise the casting, then cooling the casting to an inter-critical temperature lying between the $AC_3$ and $AC_1$ temperature and then quenching to room temperature.

The method of making a heat treated steel casting, may comprise the step of performing a castings operation to make said "as-cast" steel casting and then performing said heat treatment operation.

Preferably the heat treatment operation is performed without any intervening step between said casting operation and said heat treatment operation other than said step of cooling subsequent to casting.

The casting may be re-heated, after said cooling after casting, to a temperature lying in the range of room temperature to about 350° C.

The casting may be heated to a temperature lying in the range 900° C. to 1100° C. and preferably about 1050° C. to homogenise the casting.

The thus homogenised casting may then be cooled to a temperature lying in the range 700° C. to 800° C. at a rate lying in the range 2° C. per minute to 10° C. per minute, or 2° C. per minute to 6° C. per minute or about 5° C. per minute.

The homogenised casting may be furnace cooled to said temperature lying in the range 700° C. to 800° C.

The casting may be quenched to about room temperature by quenching at a water quenching rate and preferably by quenching the casting to about room temperature in water.

The casting may comprise 0.10%–0.20% carbon or 0.15% to 0.2%, carbon.

The casting may comprise a steel and including Mn, Cu, Ti, W

The casting may comprise a steel comprising:

C 0.1–0.2%
Mn 0.9–1.5% or 1–1.5%
S 0.002–0.015%
P 0.002–0.015%
Mo 0–0.2%
Ni 0.3–0.6% preferably 0.5%
Cr 0.3–0.6% preferably 0.5%
Nb 0–0.1%
Ti 0.02–0.10% or 0.03–0.10%
Cu 0.5–1.0%
V 0.10–0.19% preferably 0.10–0.15%
Al 0.03–0.14% or 0.030–0.12%
W 0.10–0.5% or 0.20–0.5%
Si 0.30–0.65% preferably 0.5%
$N_2$ 0.008–0.012%
$O_2$ 0.006–0.025% or 0.006–0.020%
$H_2$ 0.0003–0.0006%
Fe and
Usual Residuals Balance The steel of which the casting is made may be conventionally melted and cast, for example, in air.

According to a second aspect of the invention we provide a casting when made by the method of the first aspect of the invention.

According to a third aspect of the invention we provide a heat treated steel casting comprising not more than 0.2% carbon, a total alloy content of less than about 4%, a carbon equivalent, as herein defined, lying in the range 0.45 to 0.7 and which has been heat treated, after casting and then cooling, by re-heating the casting to a temperature above the $AC_3$ temperature to homogenise the casting, then cooling the casting to a inter-critical temperature lying between the $AC_3$ and $AC_1$ temperature and then quenching to room temperature.

The casting after said heat treatment, may comprise a two-phase structure comprising retained austenite and ferrite and at least one of an acicular bainite, acicular ferrite, bainitic ferrite and optionally martensite.

The casting, after said heat treatment, may comprise fine spheroidised carbides.

The carbides may have a size of <1 micron.

The resultant casting has a hardness lying in the range 363–500 Hb, a strength lying in the range 1200–1600 $Nmm^{-2}$, an elongation lying in the range 6–12%, a Charpy impact strength lying in the range 30–60 Joules at room temperature and 20–40 Joules at −40° C., and a yield point of not less than 600 $Nmm^2$.

In the above referred to casting the following elements are added for the reasons explained below.

Copper is added in the range 0.5 to 1.0%, to stabilise the austenite and to aid precipitation strengthening particularly during the latter part of the above described heat treatment. Below 0.5% there is insufficient copper to stabilise the austenite whilst above 1.0% there is little added effect.

Nickel in the range 0.3–0.6% is added to stabilise the austenite. Below 0.3% there is insufficient nickel to stabilise the austenite whilst above 0.6% there is little added effect.

Aluminium in the range 0.03% to 0.14% is primarily added to deoxidise the steel and also to obtain a grain refinement effect. Below 0.03% there is too little aluminium to deoxidise whilst above 0.14% there is too much aluminium to deoxidise. Accordingly a relatively high amount of aluminium is added. Whilst conventional wisdom is that the aluminium content is too high and would give rise to lower toughness we have ascertained that a relatively high residual amount of aluminium is required to achieved the desired grain refining effect.

Tungsten, vanadium, titanium and chromium are all present to form carbides and carbo-nitrides in the melt. Tungsten and vanadium are relatively strong carbide and carbo-nitride formers and titanium and chromium contribute also to carbide formation. Ti is present from 0.02% to help pin austenite grain boundaries and form a fine grain size as well as carbides and carbo-nitrides, above 0.10% Ti there is little further effect. Vanadium is present from 0.1% in order to form carbides and above 0.19% there is a reduction in toughness due to carbide coarsening. W and Cr form fine carbides above 0.1% and 0.3% respectively, whereas above 0.5% the carbide morphology leads to decreasing toughness.

The amount of molybdenum and/or niobium is strictly controlled to the maximum amounts indicated since these elements are present in the stock material from which the steel is made but neither element is necessary to be present.

Manganese in the range 0.9–1.5% is added to stabilise the austenite and to form the carbides in the melt and to help control the inclusion morphology.

Below 0.9% manganese there is insufficient manganese to stabilise the austenite and continue to modify sulphide inclusions whilst above 1.5% there is too much manganese to have a desired stabilising effect.

Si above 0.30% is provided because it is required in foundry alloys to ensure that the steel is protected from oxygen. That is to say to ensure that the steel is de-oxidised. However nickel and manganese act against the de-stabilising effect of the silicon on the austenite and hence the austenite is stabilised so long as the Si content does not exceed about 0.65%.

Carbon is present in the range 0.10% to 0.20% to form transformation carbides and to form spheroidised carbides in the acicular bainite and bainitic ferrite.

Sulphur and phosphorous are present in amounts as low as possible since they help with toughness as measured by fracture toughness and also weldability. A practical minimum of both elements is 0.002%.

In this specification the $AC_3$ temperature is the temperature below, which, on slow cooling, ferrite and austenite occur together on transformation from austenite, and the AC, temperature is the temperature below which, on slow cooling, ferrite and iron carbide occurs on transformation from a mixture of ferrite and austenite.

Carbon equivalent is an empirical relationship used to determine the equivalent carbon content of the steel for weldability purposes. A typical carbon equivalent is:

$$C \equiv C + \left(\frac{Mn}{6}\right) + \left(\frac{Cr + Mo + V}{5}\right) + \left(\frac{Ni + Cu}{15}\right)$$

The invention will now be described in more detail by way of example, with reference to the accompanying figures, wherein FIGS. 1 to 5 are at a magnification of ×50 and:

Figure 1:
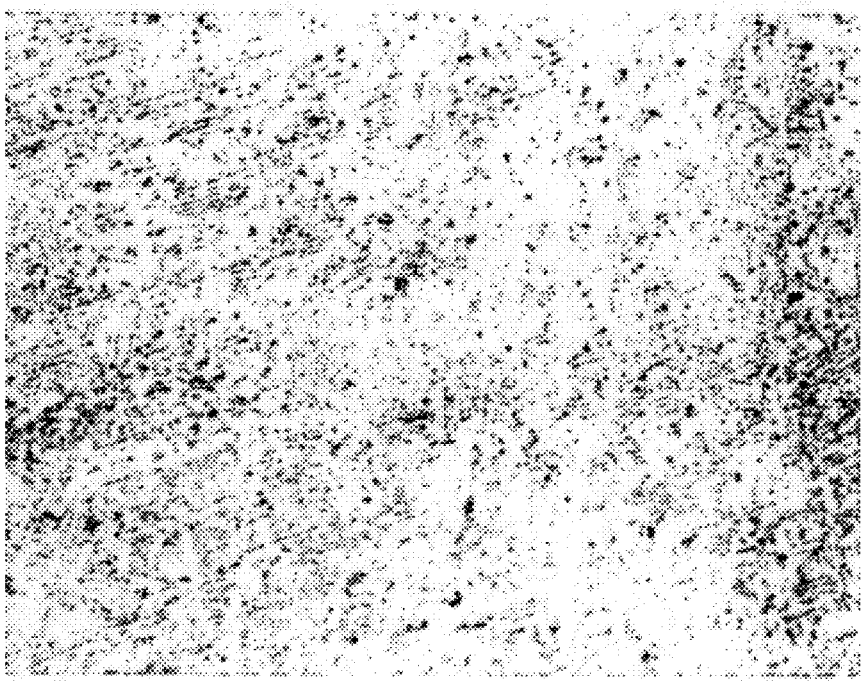
FIG. 1 is a micrograph of a casting made in accordance with the invention.
Figure 4:
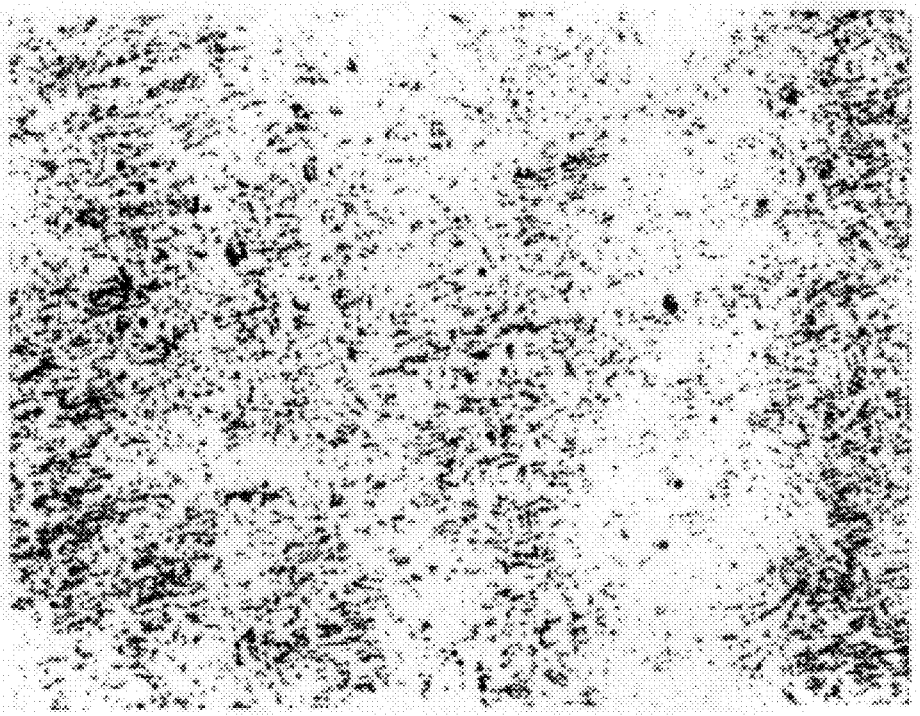
Figure 5:
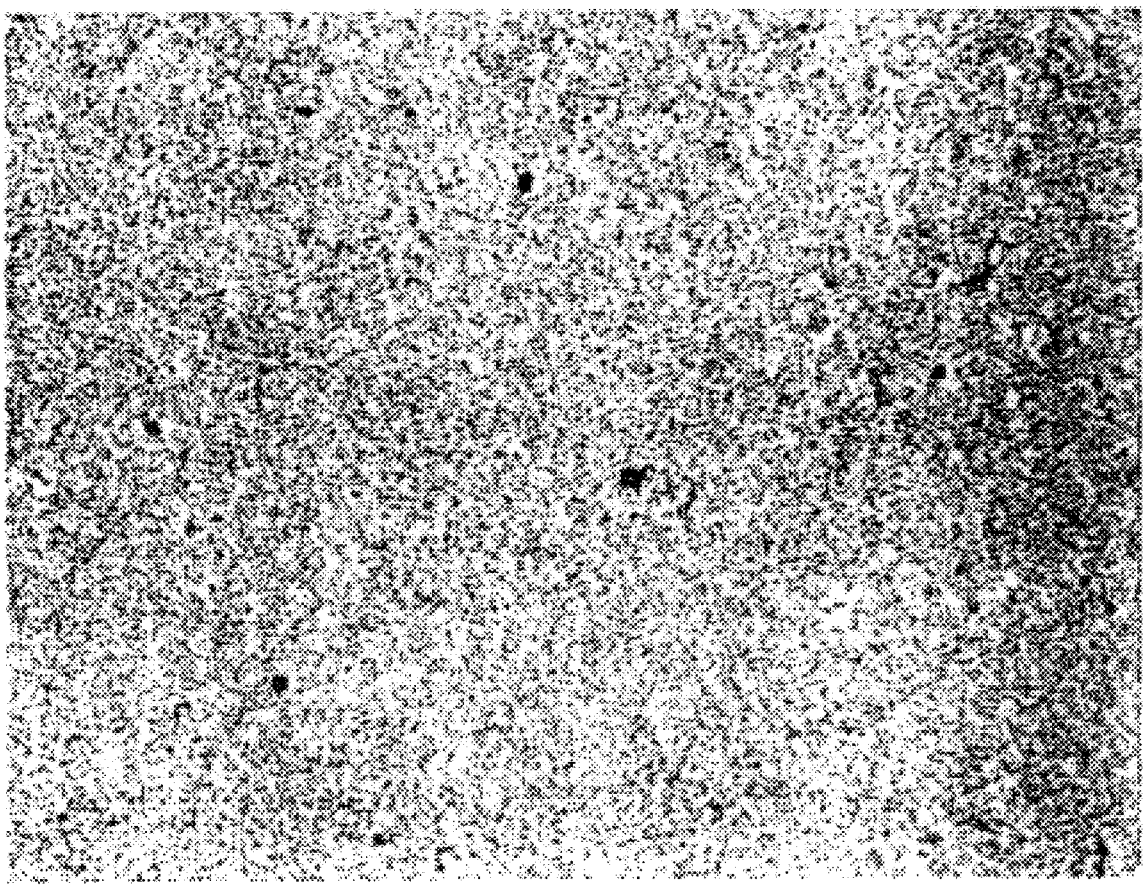
Figure 6:
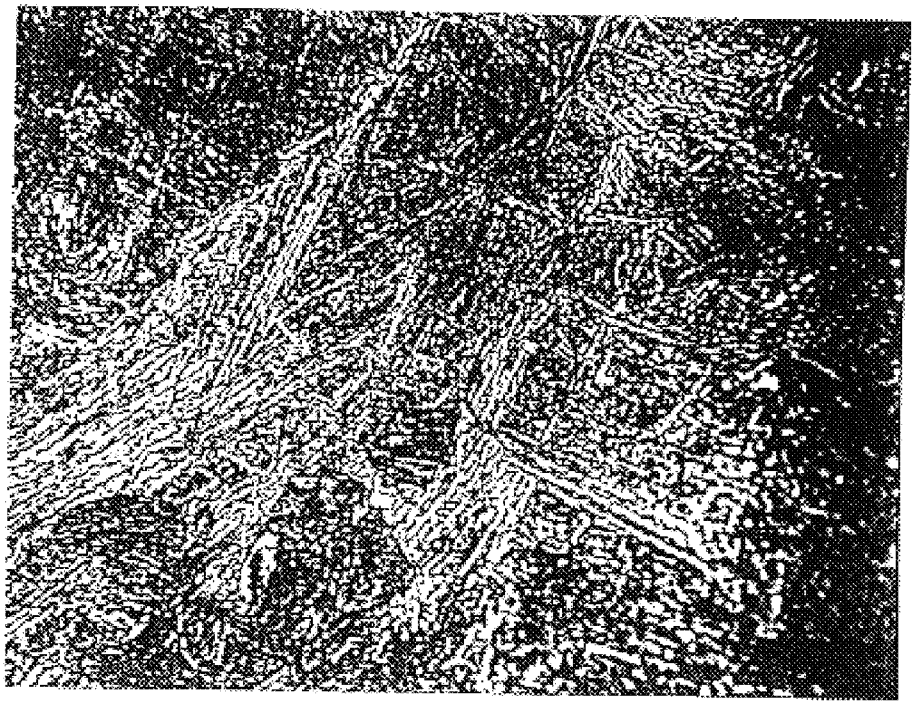
Figure 7:
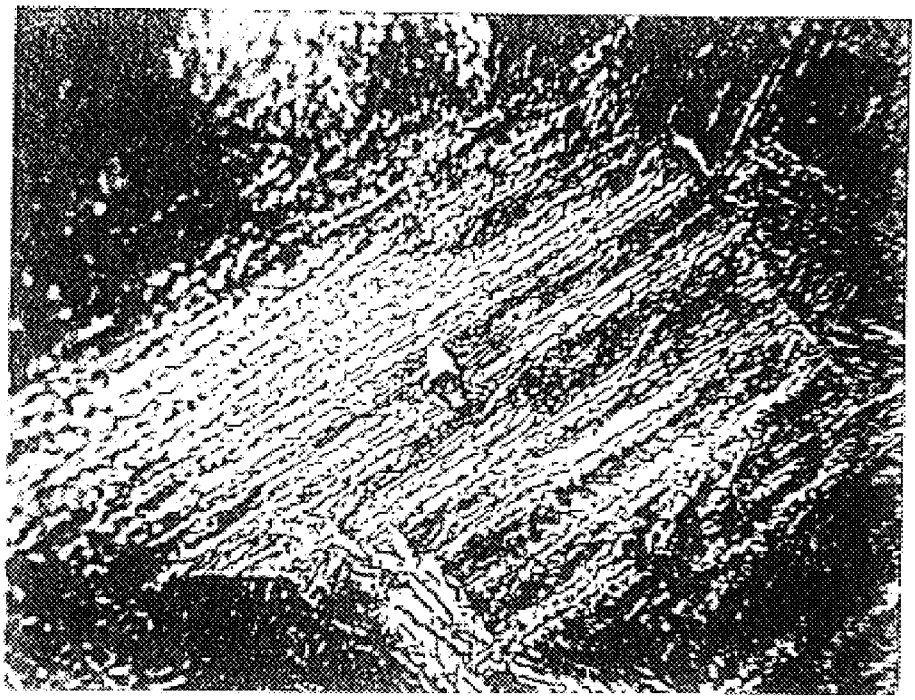
Figure 8:
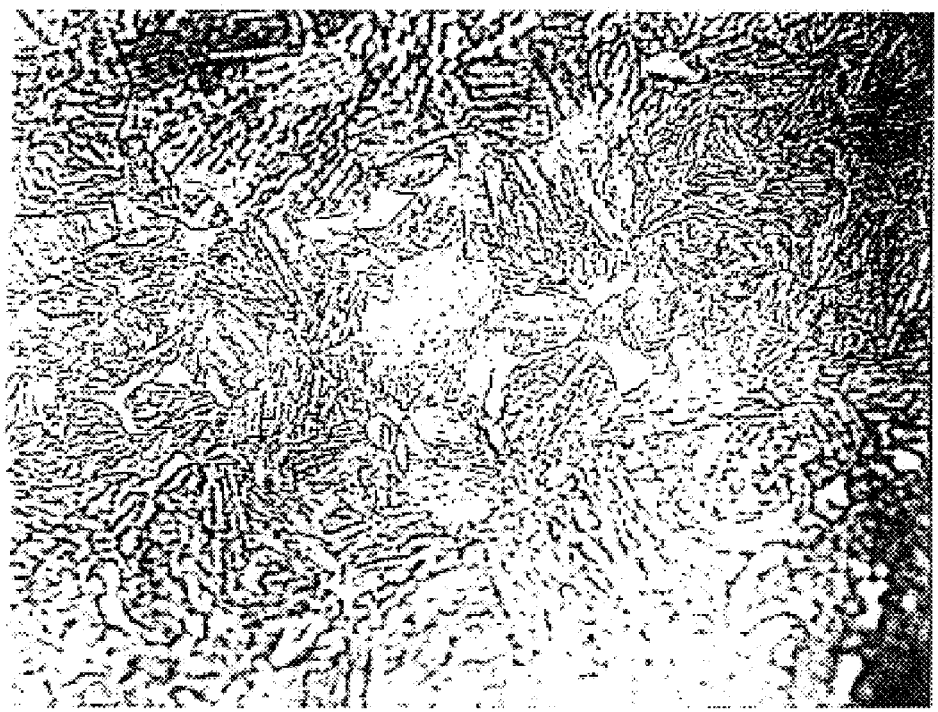
Figure 9:
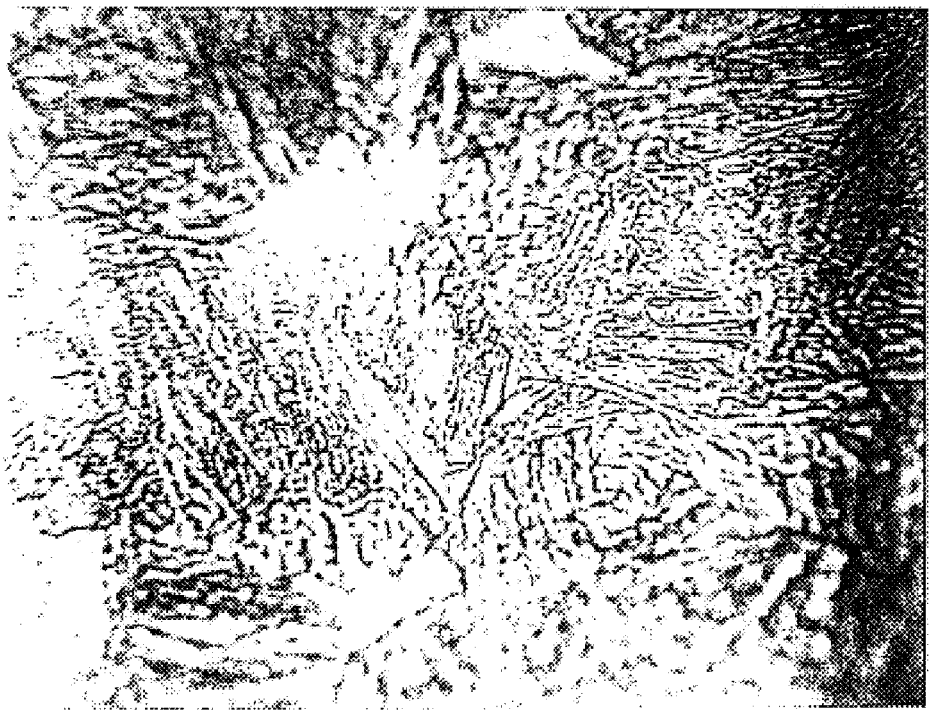
Figure 10:
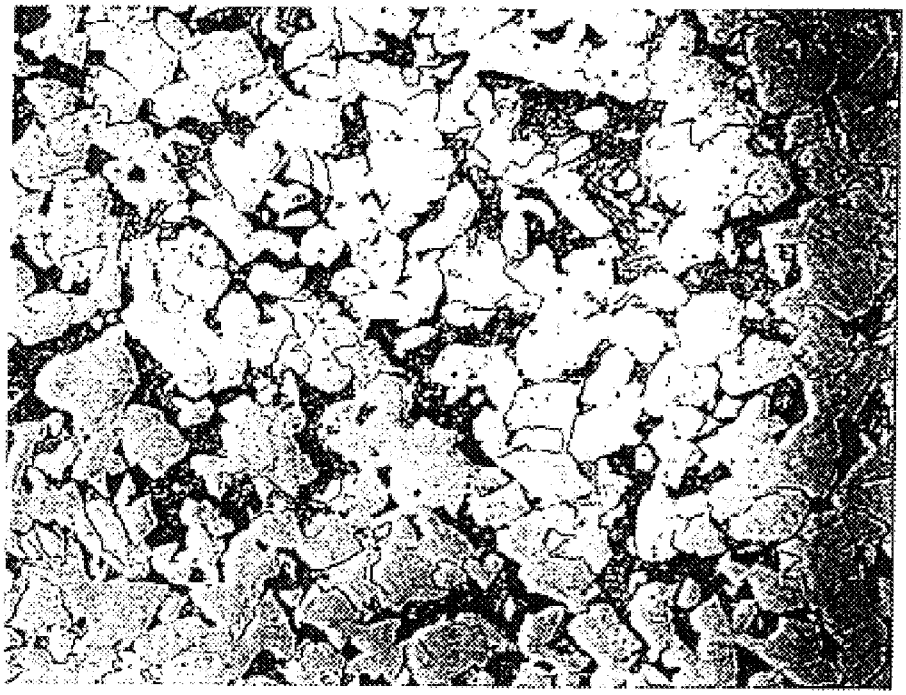
Figure 11:
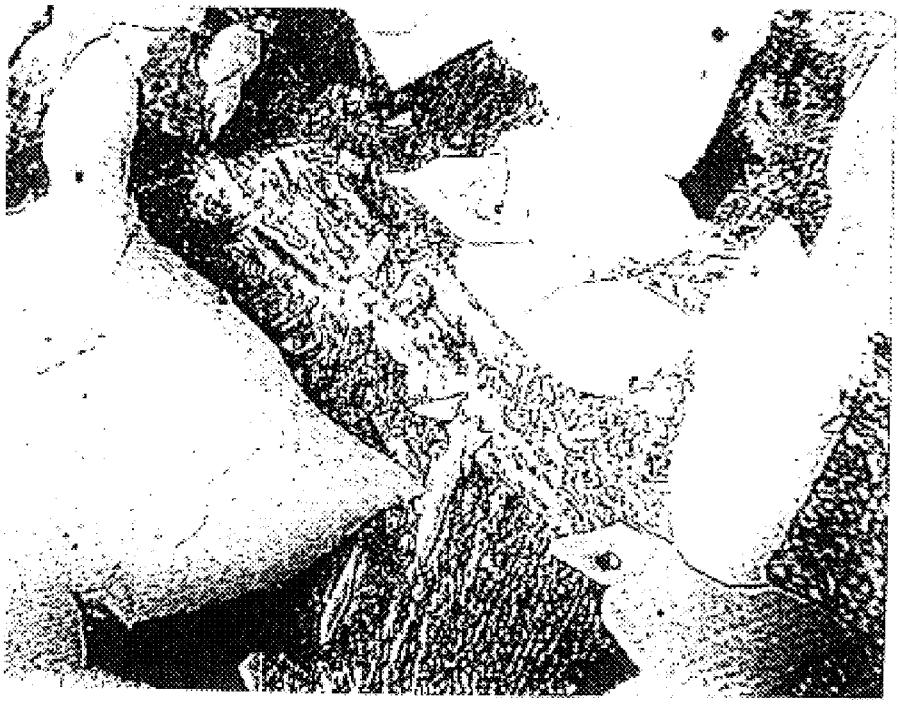

FIG. 4 is a micrograph of a casting made of the same composition as that of FIG. 1 but subjected to a yet further heat treatment, FIG. 5 is a micrograph of a casting made of the same composition as that of FIG. 1 but subjected to a still further heat treatment, FIG. 6 is a micrograph of another casting made in accordance with the invention at a magnification of ×500, FIG. 7 is a micrograph of the casting of FIG. 6 but at a magnification of ×1250, FIG. 8 is a micrograph of yet another casting made in accordance with the invention at a magnification of ×500, FIG. 9 is a micrograph of the casting of FIG. 8 but at a magnification of ×1250, FIG. 10 is a micrograph of the casting of FIG. 8 but in an "as-cast" condition at a magnification of ×63, and FIG. 11 is a micrograph of the casting of FIG. 10 but at a magnification of ×500.

EXAMPLE 1

A low alloy steel to produce a casting having high strength and toughness was made by heating clean steel stock, i.e. stock low in phosphorous and sulphur, less than 0.015% for each element, and having a low alloy content by having less than 4% in total, and having a low carbon content, in the present example, below 0.1% and was heated in conventional manner in an induction furnace, in air, to a temperature of about 1560° C. Then about 0.1% aluminium was added to the steel bath followed by the addition of the desired micro-alloying ingredients to provide an "as-cast" analysis in accordance with the table set out below.

C 0.1–0.2%
Mn 0.9–1.5% or 1–1.5%
S 0.002–0.015%
P 0.002–0.015%
Mo 0–0.2%
Ni 0.3–0.6% preferably 0.5%
Cr 0.3–0.6% preferably 0.5%
Nb 0–0.1%
Ti 0.02–0.10% or 0.03–0.10%
Cu 0.5–1.0%
V 0.10–0.19% preferably 0.10–0.15%
Al 0.03–0.14% or 0.03–0.12%
W 0.10–0.5% or 0.20–0.5%
Si 0.30–0.65% preferably 0.5%
$N_2$ 0.008–0.012%
$O_2$ 0.006–0.025% or 0.006–0.020%
$H_2$ 0.0003–0.0006%
Fe and
Usual Residuals Balance The micro alloy ingredients may be added in any desired conventional manner, for example, in the present example Ti, W and Cu were added as elements whilst the vanadium and Mn were added as ferro-alloys, and any necessary extra carbon was added to give the desired amount of carbon up to the maximum of 0.2%. In the present example Cr, Mo and Ni were not added, as adequate amounts were present in the stock material.

The resultant melt was then superheated quickly, for example at 50° C. per minute to a temperature of 1630° C. by induction heating.

The furnace was then tapped at 1630° C. and at the same time 0.1% aluminium was added into the stream of metal as it was tapped into a ladle. In the ladle there was added 0.1% of Ca, Si, Mn as a ferro alloy of calcium, silicon manganese.

The resultant steel was cast from the ladle into a shaped mould to form a casting and the resultant casting was cooled to room temperature without any intervening step.

It is believed that the sooner the casting is cooled to room temperature, the better, in order to avoid "fade" of the alloy additions.

After cooling of the casting to room temperature the casting was heat treated in a single step, again without any intervening step to avoid delay. The single step comprised re-heating the casting to 1050° C. to homogenise the casting.

This was done in a conventional air furnace. After homogenising the furnace was cooled to 750° C. at a nominal rate of about 5° C. per minute. Then the casting was water quenched to room temperature. A sample was cut from the casting at a position of mid-section and was prepared in conventional manner. If desired, the furnace may be cooled to a temperature in the range 780° C. to 730° C. As the temperature is reduced in this range all the mechanical properties are retained except for the yield point. This is considered to be because the volume fraction of the ferrite increases at the expense of bainite.

As can best be seen from FIG. 1, the micro-structure was a definite two-phase structure showing in the white phase, basically retained austenite or ferrite and showing, in the other phase acicular bainite with some bainitic ferrite and martensite together with very fine carbides which were sphieroidised because of the above mentioned heat treatment. The carbides have a size of less than 1 micron. Although the above mentioned carbide formers will form carbides with carbon in the melt in accordance with stoichiometric rules, carbo-nitrides may also be formed such as titanium or vanadium carbo-nitrides, and hence the nitrogen content is kept as specified in the above mentioned table. The role of the alloying elements in the resultant casting have previously been explained and do not require re-explanation herein.

In the example described hereinbefore and illustrated in FIG. 1, the casting has a composition as follows:

C 0.19%
Mn 1.09%
S 0.004%
P 0.007%
Mo 0.15%
Ni 0.47%
Cr 0.53%
Nb 0.0004%
Ti 0.043%
Cu 0.69%
V 0.16%
Al 0.082%
W 0.25%
Si 0.63%
$N_2$ 0.008–0.012%
$O_2$ 0.006–0.020%
$H_2$ 0.0003–0.0006%
Fe and
Usual Residuals Balance Carbon equivalent 0.62.

As mentioned above, the example shown in FIG. 1 has been subjected to a heat treatment in accordance with the invention and when a sample was tested was found to have the following physical properties:

Hardness 400–415 Hb
UTS 1331 $Nmm^{-2}$
Elongation 7%
Reduction in Area 20%
Impact resistance (Charpy RT) 44 J
Impact resistance (Charpy −40° C.) 23 J
Yield Point 1061 $Nmm^{-2}$ It will be noted that the resultant casting was relatively tough for a given hardness level.

EXAMPLE 2

A steel of the same composition as mentioned above was made into a casting similar to that described hereinbefore but the casting was subjected to a conventional heat treatment process in which the steel was originally treated 1050° C. and then water quenched to room temperature and then subsequently tempered at 450° C.

This conventional heat treatment of a casting made otherwise in the same manner as the example of FIG. 1 gave the following physical properties:

Hardness 375 Hb
UTS 1193 $Nmm^{-2}$
Elongation 5%
Reduction in Area 10%
Impact resistance (Charpy RT) 15 J
Yield Point 1164 $Nmm^{-2}$ In all cases the physical parameters were lower than in the sample made in accordance with the invention and heat treated in accordance with the invention.

EXAMPLES 3 & 4

In Examples 3 & 4 steel castings having a composition as set out below and heat treated as described hereinafter were made as for Example 1.

C 0.17%
Mn 0.49%
S 0.010%
P 0.005%
Mo 0.005%
Ni 0.017%
Cr 0.024%
Nb 0.003%
Ti 0.080%
Cu 0.008%
V 0.001%
Al 0.003%
W 0.37%
Si 2.31%
$N_2$ 0.008–0.012%
$O_2$ 0.006–0.020%
$H_2$ 0.0003–0.0006%
Fe and
Usual Residuals Balance Carbon equivalent 0.29.

One sample, Example 3, was subjected to a heat treatment in accordance with the invention as described in connection with the first example, whilst another sample, Example 4, was subjected to the hereinbefore described conventional heat treatment. The following results were obtained.

| | Example 3 | Example 4 |
|---|---|---|
| Hardness | 207 Hb | 187 |
| UTS | 405 $Nmm^{-2}$ | 506 $Nmm^{-2}$ |
| Elongation | 2% | 3% |
| Reduction in Area | 2% | 2% |
| Impact resistance (Charpy RT) | 7 J | 6 J |
| Yield Point | 400 $Nmm^{-2}$ | 394 $Nmm^{-2}$ |

It will be seen that the sample of Example 3 failed to respond to the heat treatment in accordance with the invention. The composition contained 0.37% tungsten and 0.08% titanium and contained effectively no vanadium, copper or chromium.

EXAMPLE 5

In a fifth example, again made as described hereinbefore a sample was taken from a casting which had been heat treated, in this case, only by a heat treatment in accordance with the invention. Example 5 had a composition in accordance with the following table:

C 0.27%
Mn 0.83%
S 0.010%
P 0.014%
Mo 0.10%
Ni 0.55%
Cr 0.60%
Nb 0.13%
Ti 0.054%
Cu 0.80%
V 0.19%
Al 0.085%
W 0.31%
Si 0.75%
$N_2$ 0.008–0.012%
$O_2$ 0.006–0.020%
$H_2$ 0.0003–0.0006%
Fe and
Usual Residuals Balance Carbon equivalent 0.67.

A sample of this example after heat treatment in accordance with the invention was tested and was found to have the following physical properties:
Hardness 415 Hb
UTS 1189 $Nmm^{-2}$
Elongation 3%
Reduction in Area 24%
Impact resistance (Charpy RT) 8 J Yield Point 1074 $Nmm^{-2}$ It will be seen that this alloy had 0.31% tungsten, 0.085% aluminum, 0.19% vanadium and 0.80% copper. Accordingly the above mentioned elements lie within the range specified in accordance with the invention but the carbon content at 0.27% and the niobium content at 0.13% are too high and outside the specified range. It will be noted that whilst the hardness and UTS values are similar, the toughness is only 8 Joules.

This sample, like the sample of the first example, was also subjected to a fatigue test, and found to have a fatigue life of only $10^5$ cycles compared with the invention's fatigue life of $10^6$ cycles.

EXAMPLE 6

In example 6 a steel was again made as described in connection with the first embodiment and had a composition as set out in the following table:
C 0.18%
Mn 0.98%
S 0.005%
P 0.011%
Mo 0.12%
Ni 0.50%
Cr 0.68%
Nb 0.008%
Ti 0.074%
Cu 0.69%
V 0.01 %
Al 0.11%
W 0.257%
Si 0.47%
$N_2$ 0.010%
$O_2$ 0.006–0.020%
$H_2$ 0.0003–0.0006%
Fe and
Usual Residuals Balance Carbon equivalent 0.58.

It sill be seen that this composition was similar to that of the composition in accordance with the invention as set out in the table of Example 1 except for the substantive absence of vanadium. A sample of a casting in accordance with the example was made using a heat treatment in accordance with the invention and was found to have the following physical properties:
Hardness 415 Hb
UTS 1340 $Nmm^{-2}$
Elongation 9%
Reduction in Area 22%
Impact resistance (Charpy RT) 28 Joules Yield Point 725$Nmm^{-2}$ It will be seen that the impact resistance at 28 Joules was relatively low compared with the impact resistance of 44 Joules Example 1 and that is considerably due to the essential absence of vanadium.

The fatigue tests described hereinbefore were carried out with a mean stress of 272 $Nmm^{-2}$ and with a stress ratio, R=0.01 and frequency of 10 Hz. The cycles to failure or, in the case of the example in accordance with the invention, to the cessation of testing, were measured.

Referring now to the Figures, in all the Figures a sample was taken from the casting of Example 1 and subjected to differing heat treatments.

FIG. 1 illustrates example 1 subsequent to the heat treatment described hereinbefore in accordance with the invention and accordingly it clearly shows a two phase structure comprising retained austenite or ferrite as the white structure and acicular bainite with a small amount of bainitic ferrite and martensite. The acicular bainitic structure gives the casting it relatively high hardness of around 500 Hv with a 200 gm load whilst the retained austenite or ferrite, at a hardness of around 200 Hv, gives the casting its toughness whilst the microcarbides smooth out the lattice strength.

Figure 2:
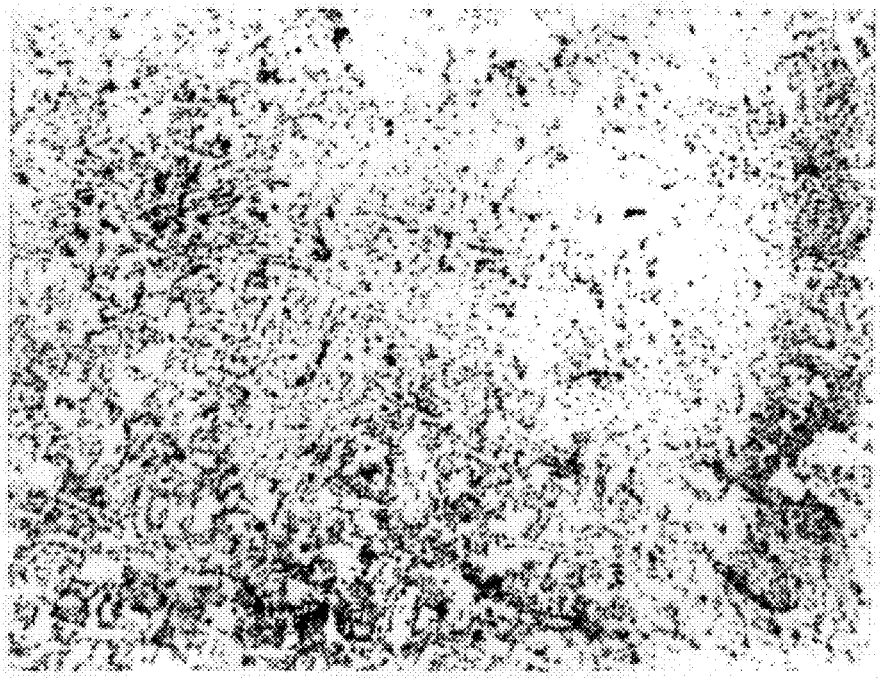
FIG. 2 is a micrograph of a casting the same composition as that of FIG. 1.

In FIG. 2 a widmanstatten structure is illustrated to demonstrate the "as cast structure" where the micrograph shows widmanstatten ferrite and fine pearlite.

Accordingly FIG. 2 illustrates the "as cast" structure of a sample of the example of FIG. 1.

Figure 3:
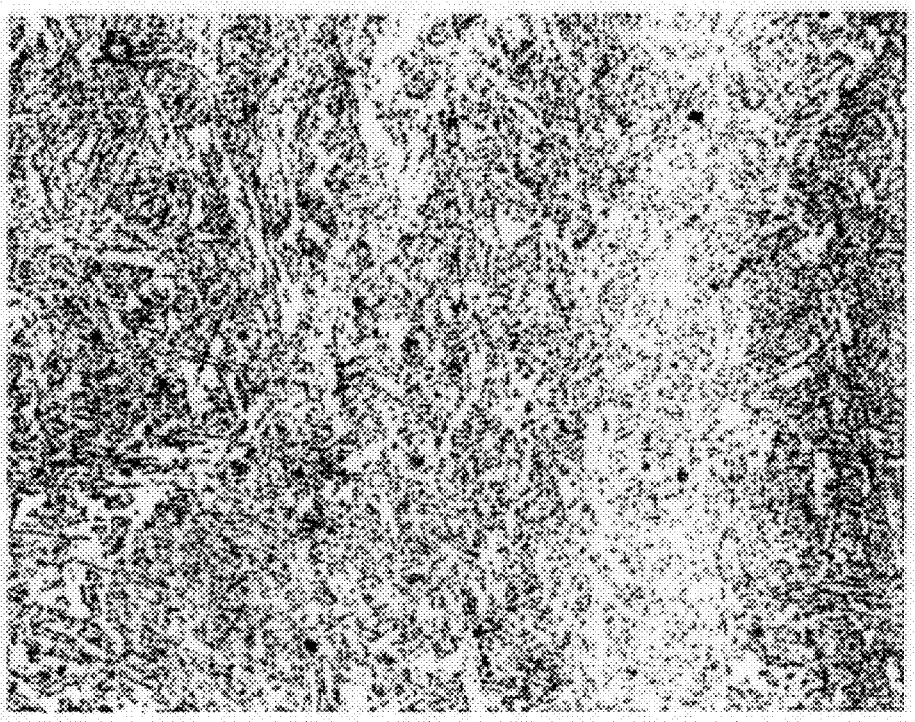
FIG. 3 is a micrograph of a casting of the same composition but subject to a different heat treatment to the steel of the micrograph of FIG. 1.

FIG. 3 shows the Example of FIG. 1 subject to a heat treatment in which the casting is homogenised at 1050° C., furnace cooled to 500° C. and then water quenched. As a result of furnace cooling to a temperature of 500° C., whilst below the claimed range, the micrograph illustrates in the "white" part of the microstructure a structure which is feathery upper bainite with a little lower bainite and martensite. The microstructure is not a true two phase structure since the "white" feathery upper bainite is not a truly white structure and is effectively a "dark phase". The resultant microstructure is not so tough and not so hard.

FIG. 4 shows the Example of FIG. 1 is subject to a heat treatment in which the casting is homogenised 1050° C., air cooled to 730° C. and then water quenched. As a result of air cooling to 730° C., which is a faster cooling rate than claimed (for example, of the order of 10° C. per minute) the micrograph illustrates a two phase structure where the white phase is again retained austenite or ferrite but in this example more martensite is obtained than in FIG. 3 and hence the impact strength is reduced and the martensite is much darker than that of FIG. 2 due to the faster cooling rate.

The micrograph of FIG. 4 shows that it is important to slow cool i.e. furnace cool at a rate lying in the range 2° C. to 6° C./minute from a reheating temperature of 900° C. to 1100° C.

FIG. 5 shows the Example of FIG. 1 when subjected to a heat treatment in which the casting is homogenised at 1050° C. and then air cooled to 450° C. and then water quenched. As a result of air cooling in combination with cooling to a lower temperature the micrograph shows a micro-structure comprising a single phase of lower bainite which is neither hard enough nor tough enough.

In accordance with the present invention it is necessary to cool, during the above mentioned heat treatment to a temperature of 700° C. to 800° C. which in the present example is above about 750° C. The heat treatment in accordance with the invention is a combination of a heat treatment above the $AC_3$ temperature of 860–890° C. by heating to about 1050° C. and a inter-critical heat treatment below the $AC_3$ temperature but above $AC_1$ at around 750° C. and at a minimum of around 700° C. This is to be contrasted with the previously known heat treatment where initially a casting is homogenised and then cooled to room temperature followed by heating by tempering up to a sub-critical heat treatment.

In accordance with the invention the casting is heated to the above mentioned homogenising heat treatment at about 1050° C. which is well above the $AC_3$ temperature and then is furnace cooled, i.e. cooled relatively slowly at a rate within the above mentioned range to provide a inter-critical heat treatment, i.e. between the $AC_1$ and the $AC_3$ temperatures. Whereas conventionally castings are homogenised at the range 870° C. to 1150° C. and then quenched to room temperature followed by re-heating to a sub-critical temperature.

By homogenising at, for example, 1050° C. the carbides formed in the melt are broken down and the grain structure is refined from the structure conventionally encountered and illustrated in FIG. 2. The casting is then furnace cooled to the inter-critical zone, the object of which is to spheroidise the carbide and retain the austenite by cooling to about 750° C. relatively slowly. The desired acicular bainite is obtained. It is believed that the desired hardness is obtained from the bainitic phase and the toughness is obtained from the retained austenite and ferrite and the spheroidised carbides.

Although in the above described examples of microstructures of examples in accordance With the invention, reference is made to the white phase containing retained austenite. It may also contain ferrite as well as the ferrite which is transformed to bainite or bainite and martensite. It is to be noted that martensite normally gives a hardness of about 550 to 650 Hv, whilst acicular bainite gives a hardness of about 400 to 450 Hv, which is generally equivalent to the hardness found in practice by testing the samples. In addition Example 1 provides a toughness of approximately 40 Joules.

The table below sets out the composition of two further examples, examples 7 and 8 which were made as described herein before in connection with example 1 and subjected to a heat treatment in accordance with the invention as described in connection with example 1.

EXAMPLE 7

Heat No. BP137
C 0.20
Mn 0.93
S 0.007
P 0.012
Mo 0.14
Ni 0.45
Cr 0.50
Ti 0.060
Cu 0.66
V 0.13
Al 0.089
W 0.30
Si 0.56
$N_2$ 0.011
$O_2$ 0.021
Fe and
Usual Residuals Balance
Carbon equivalent 0.58

When a sample in accordance with Heat No. BP137 was tested it was found to have the following physical properties.

Hardness 388 Hb
UTS 1338 Nmm−2
Elongation 6%
Reduction in Area 10%
Impact resistance
(Charpy −40° C.) 21 J
(Charpy −20° C.) 37 J
Yield Point 907 $Nmm^{-2}$

EXAMPLE 8

Heat No. AR087
C 0.15
Mn 1.13
S 0.006
P 0.020
Mo 0.15
Ni 0.60
Cr 0.46
Ti 0.020
Cu 0.60
V 0.14
Al 0.140
W 0.16
Si 0.41
$N_2$ 0.008
$O_2$ 0.024
Fe and
Usual Residuals Balance
Carbon Equivalent 0.57

When a sample in accordance with Heat No. AR087 was tested it was found to have the following physical properties.

Hardness 363 Hb
UTS 1209 $Nmm^{-2}$
Elongation 11%
Reduction in Area 21%
Impact resistance
(Charpy −40° C.) 31 J
(Charpy −20° C.) 34 J
(Charpy −0) 41 J
(Charpy 20) 51 J
Yield Point 806 $Nmm^{-2}$ In the above the Charpy results are plotted as the average of a number of tests and in the case of heat No. AR087 show the results on testing at the different temperatures stated.

FIGS. 6 and 7 are micrographs of samples of heat No. BP137 and they show a two phase structure with some retained austenite or ferrite and acicular bainite ferrite and martensite.

FIGS. 8 and 9 are micrographs of samples taken from heat No. AR087 and they also show a two phase structure, in this case showing more ferrite and retained austenite and acicular bainite with bainitic ferrite and less acicular ferrite than in the case of heat No. BP137.

For comparison FIGS. 10 and 12 are micrographs of samples taken from heat No. AR087 but in the "as-cast" condition ie. before heat treatment in accordance with the present invention and it shows equiaxed ferrite and Widmanstatten ferrite and pearlite.

Castings in accordance with the invention have wide application but for example, they may be utilised to provide railway couplers where it is specifically desired to obtain high strength and toughness with a minimum weight. Such couplers allow the achievement of up to 50% improvement in strength and wear resistance and in addition they suffer from lower frequency fatigue which is also considerably improved by steels embodying the invention.

Castings embodying the invention are also useful in that they are weldable and a particular application of such steels is for the bogies of railway vehicles such as passenger trains where side frames have portions which are welded together. Again a steel embodying the invention enables the use of up to half the amount of material previously used, and hence half the weight previously required.

Because we have a carbon equivalent in the range stated, castings embodying the invention have the above-mentioned weldability. If the carbon equivalent were less than 0.45 the castings would not require any pre-heat neither would they require any post-heat relative to the heat applied during welding. If the carbon equivalent were over 0.7 it would be necessary not only to pre-heat the casting, but also to post-heat the casting. By operating in the specified range the desired properties for weldability are achieved.

In this specification all percentage compositions are expressed in "% by weight" all yield points are 0.2% proof stress, and Charpy tests are ISO-V tests at the temperatures specified (RT=room temperature), and all elongations are with a gauge length of 4 times the diameter of the test piece.

The features disclosed in the foregoing description, or the following claims, or the accompanying drawings, expressed in their specific forms or in terms of a means for performing the disclosed function, or a method or process for attaining the disclosed result, as appropriate, may, separately or in any combination of such features, be utilised for realising the invention in diverse forms thereof.

I claim:

1. A method of making a heat treated steel casting comprising the steps of performing a casting operation to make an "as-cast" steel casting comprising not more than 0.2% carbon, a total alloy content of less than about 4%, a carbon equivalent, as herein defined, lying in the range 0.45–0.7% and cooling the casting after performing the casting operation and then performing a heat treatment operation by re-heating the casting to a temperature above the $AC_3$ temperature to homogenize the casting without any intervening step between said casting operation and said heat treatment operation other than said step of cooling subsequent to casting, then cooling the casting to an intercritical temperature lying between the $AC_3$ and $AC_1$ temperature and then quenching to room temperature.

2. A method according to claim 1 wherein the casting is re-heated, after said cooling after casting, to a temperature lying in the range of room temperature to about 350° C.

3. A method according to claim 1 wherein the casting is heated to a temperature lying in the range 900° C. to 1100 ° C. to homogenise the casting.

4. A method according to claim 1 wherein the homogenized casting is then cooled to a temperature lying in the range 700° C. to 800° C. at a cooling rate selected from the group consisting of the range of 2° C. per minute to 10° C. per minute, the range of 2° C. per minute to 6° C. per minute, and about 5° C. per minute.

5. A method according to claim 4 wherein the homogenised casting is furnace cooled to said temperature lying in the range 700° C. to 800° C.

6. A method according to claim 1 wherein the casting is quenched to about room temperature by quenching at a water quenching rate.

7. A method according to claim 6 wherein the casting is quenched by quenching the casting to about room temperature in water.

8. A method according to claim 1 wherein the casting comprises 0.10%–0.20% carbon.

9. A method according to claim 9 wherein the casting comprises 0.15% to 0.20% carbon.

10. A method according to claim 1 where the casting comprises a steel including Mn, Cu, Ti, and W.

11. A method of making a heat treated steel casting comprising the steps of taking an "as-cast" steel casting wherein the casting comprises a steel comprising C 0.1–0.2%
Mn 0.9–1.5%
S 0.002–0.015%
P 0.002–0.015%
Mo 0–0.2%
Ni 0.3–0.6%
Cr 0.3–0.6%
Nb 0–0.19%
Ti 0.02–0.10%
Cu 0.5–1.0%
V 0.10–0.19%
Al 0.03–0.14%
W 0.10–0.5%
Si 0.30–0.65%
$N_2$ 0.008–0.012%
$O_2$ 0.006–0.025%
$H_2$ 0.0003–0.0006%
Fe and
Usual Residuals Balance, cooling the casting after performing the casting operation, performing a heat treatment operation by re-heating the casting to a temperature above the $AC_3$ temperature to homogenize the casting, cooling the casting to an intercritical temperature lying between the $AC_3$ and $AC_1$ temperature, and quenching to room temperature.

12. A heat treated steel casting comprising not more than 0.2% carbon, a total alloy content of less than about 4%, a carbon equivalent, as herein defined, lying in the range 0.45 to 0.7% and which has been heat treated, after casting and then cooling, by re-heating the casting to a temperature above the $AC_3$ temperature to homogenize the casting without any intervening step between said casting and said re-heating other than said step of cooling subsequent to casting, then cooling the casting to a intercritical temperature lying between the $AC_3$ and $AC_1$ temperature and then quenching to room temperature.

13. A casting according to claim 12 wherein the casting, after said heat treatment, comprises a two-phase structure comprising retained austenite and ferrite and at least one of an acicular bainite, acicular ferrite, bainitic ferrite and optionally martensite.

14. A casting according to claim 12 wherein the casting, after said heat treatment, comprises fine spheroidised carbides.

15. A casting according to claim 14 wherein the carbides have a size of <1 micron.

16. A casting according to claim 15 wherein the resultant casting has a hardness lying in the range 363–500 Hb, a strength lying in the range 1200–1600 $Nmm^{-2}$, an elongation lying in the range 6–12%, a Charpy impact strength lying in the range 30–60 Joules at room temperature and 20–40 Joules at −40° C., and a yield point of not less than 600 $Nmm^2$.

17. A casting according to claim 12 wherein the casting is weldable.

18. The method of claim 11 wherein Mn is approximately 1–1.5%.

19. The method of claim 11 wherein Ni is approximately 0.5%.

20. The method of claim 11 wherein Cr is approximately 0.5%.

21. The method of claim 11 wherein Ti is approximately 0.03–0.10%.

22. The method of claim 11 wherein V to approximately 0.10–0.15%.

23. The method of claim 11 wherein Al is approximately 0.030–0.12%.

24. The method of claim 11 wherein W is approximately 0.20–0.5%.

25. The method of claim 11 wherein Si is approximately 0.5%.

26. The method of claim 11 wherein $O_2$ is approximately 0.006–0.020%.

27. A heat treated steel casting comprising:

C 0.1–0.2%
Mn 0.9–1.5%
S 0.002–0.015%
P 0.002–0.015%
Mo 0–0.2%
Ni 0.3–0.6%
Cr 0.3–0.6%
Nb 0–0.1%
Ti 0.02–0.10%
Cu 0.5–1.0%
V 0.10–0.19%
Al 0.03–0.14%
W 0.10–0.5%
Si 0.30–0.65%
$N_2$ 0.008–0.012%
$O_2$ 0.006–0.025%
$H_2$ 0.0003–0.0006%
Fe and
Usual
Residuals Balance and which has been heat treated, after casting and then cooling, by re-heating the casting to a temperature above the $AC_3$ temperature to homogenize the casting, then cooling the casting to an inter-critical temperature lying between the $AC_3$ and $AC_1$ temperature and then quenching to room temperature.

* * * * *